United States Patent [19]

Volks

[11] Patent Number: 4,537,157

[45] Date of Patent: Aug. 27, 1985

[54] VERTICAL, COLLECTOR-TYPE HIGH-PRESSURE FEED WATER PREHEATER, WITH A DESUPERHEATER CASING

[75] Inventor: Günter Volks, Lauchringen, Fed. Rep. of Germany

[73] Assignee: BBC Brown, Boveri & Company, Limited, Baden, Switzerland

[21] Appl. No.: 508,713

[22] Filed: Jun. 28, 1983

[30] Foreign Application Priority Data

Jun. 30, 1982 [CH] Switzerland ..... 3991/82

[51] Int. Cl.[3] ..... F22D 1/00

[52] U.S. Cl. ..... 122/412; 122/493; 122/510; 122/512; 165/162

[58] Field of Search ..... 122/235 A, 235 O, 493, 122/496, 360, 365, 510, 511, 512, 412, 467; 165/162

[56] References Cited

U.S. PATENT DOCUMENTS 3,998,268 12/1976 Sagan ..... 165/162
4,220,199 9/1980 Romanos ..... 122/510
4,257,360 3/1981 von Bockh ..... 122/510
4,344,480 8/1982 Boyer et al. ..... 165/162

FOREIGN PATENT DOCUMENTS 1132413 9/1982 Canada ..... 122/512

*Primary Examiner*—Henry C. Yuen
*Assistant Examiner*—Steven E. Warner
*Attorney, Agent, or Firm*—Oblon, Fisher, Spivak, McClelland & Maier

[57] ABSTRACT

Support points (15) are provided in the duct-shaped portions (17–22) of the desuperheater casing, at which points the serpentine tubes (25) of the preheater tube-bundle are fixed in a direction, at right-angles to the longitudinal direction of the tubes, by means of support strips (24) which bear against the tubes in a manner permitting movement in the longitudinal direction. The support strips (24) are composed of sheet steel, and possess spacer tabs (26) which extends at right-angles to the plane of the sheet steel. The ability of the support strips to shift relative to the serpentine tubes (25) is limited by supporting crosspieces (22) on two opposite web sheets (21) belonging to the support point (15).

1 Claim, 6 Drawing Figures

FIG. 5
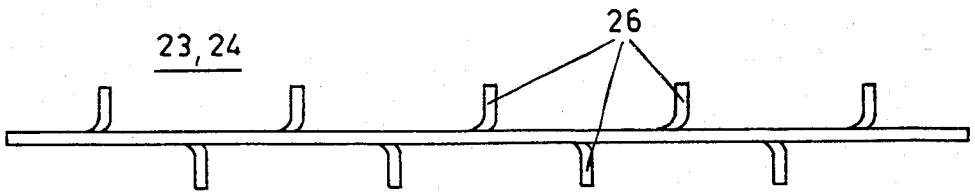
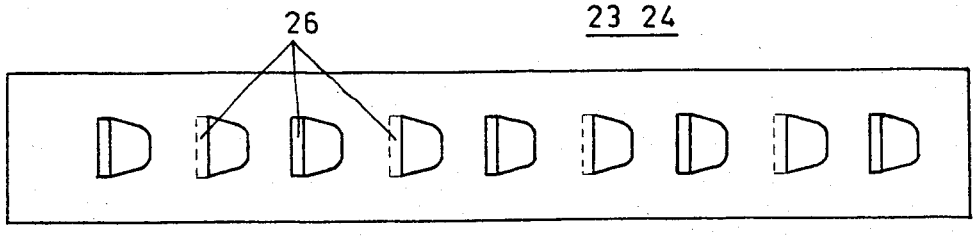
FIG. 6

VERTICAL, COLLECTOR-TYPE HIGH-PRESSURE FEED WATER PREHEATER, WITH A DESUPERHEATER CASING

BACKGROUND OF THE INVENTION

1. Field of the Invention

The present invention relates to a vertical, collector-type high-pressure feed water preheater, with a desuperheater casing.

2. Description of the Prior Art

In the case of vertical, collector-type high-pressure feed water preheaters, which are heated by means of interstage bleed steam, it is possible, if the steam enters at a high temperature in the region of the outlet feed water collector, to provide a desuperheater casing in which the inflowing steam gives off so much heat that it is completely condensed at the end, that is at the feed water inlet header. In this design, the desuperheater casing forms a jacket which encloses the last portion of the serpentine tubes forming the preheater, upstream of the points at which they open into the outlet feed water collector, in a manner such that the steam is constrained to flow over the preheater tubes in the longitudinal direction, as a result of which good heat transmission occurs in this portion of the preheater, and the steam is cooled by the desired amount. At the end of this portion of the preheater, the steam emerges at right-angles to the adjacent leg of the preheater tubes, so that it can then condense completely over the remainder of the area of the serpentine tubes which form the preheater.

In the case of the known designs of vertical high-pressure feed water preheaters, of this type, the means for supporting the preheater tubes present problems, for which purpose there are typically provided split supporting plates, straight strips with and without webs, corrugated strips and comb-plates. The use of these devices creates the disadvantage that it is necessary to adjust these supporting structures to fit the tubes, and to weld them to the jacket of the desuperheater casing. This type of manufacturing procedure is complicated, and there is a danger of the tubes jamming, in which event large reaction forces can occur as the result of thermal expansions. Since a supporting structure of this kind significantly restricts the flow cross-section, comparatively high steam velocities occur there, which could give rise to erosion effects if condensation has already started in the desuperheater. Moreover, comparatively high pressure losses are associated with supporting structures of this kind.

SUMMARY OF THE INVENTION

The present invention has as its object to avoid these disadvantages of the known designs. In particular, the support for the tubes are designed in a manner such that the flow cross-section is only moderately restricted in the region of the support, as a result of which the steam velocities do not become excessively high in this region, such that jamming of the tubes is reliably prevented while nevertheless ensuring that the flow cannot excite vibration, such as to guarantee that the various components can expand freely relative to one another under all operating conditions and such that, in addition, the assembly of the serpentine tubes, with the support elements and the jacket of the desuperheater, is simple and necessitates no welding.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

Figure 1:
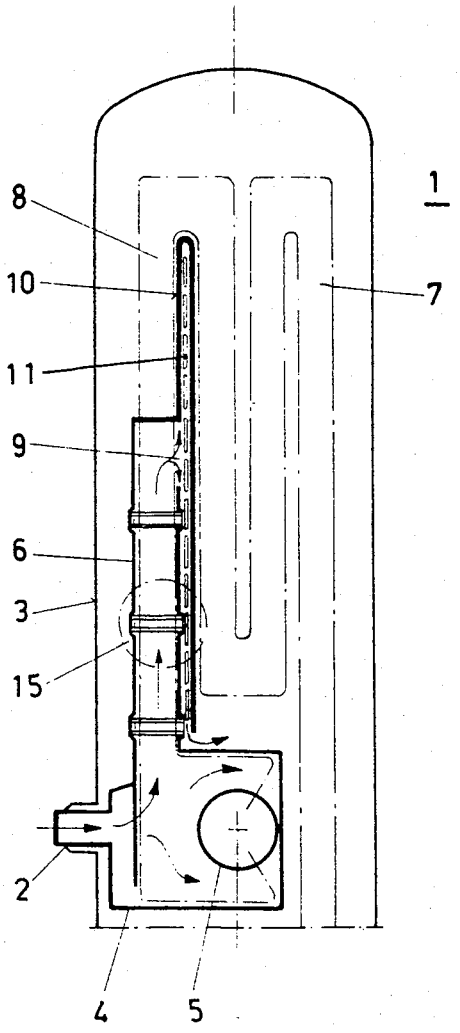
FIG. 1 schematically shows, a longitudinal section through the main portion of a preheater of the type to which the invention relates, FIG. 2 schematically shows, a variant of a preheater of the above type, in longitudinal section.

FIG. 1 shows the upper portion of a high-pressure feed water preheater 1, in which the elements which are essential to the invention are located. The heating steam is supplied through a steam inlet pipe-connection 2 in the boiler shell 3 of the preheater, the condensate deriving from this steam collecting in that portion of the preheater which is located below the dash/dotted horizontal line, and which is not shown. The inlet pipe-connection 2 opens directly into the desuperheater casing 4, which encloses, in a leak-tight manner, the tubes in the region of the outlet feed water collector 5 and, by means of a duct 6 for the heating steam, adjoining the desuperheater casing in the upward direction, encloses the downward-leading leg 8 of the serpentine tube-bundle 7, the boundary of this leg being indicated by the dash/dotted line the duct 6 extending, in the upward direction, up to a point higher than halfway up this leg. Approximately halfway up this leg, the duct 6 possesses an aperture 9, which is directed towards the center of the shell of the preheater, this aperture opening into a steam-distribution duct 10 which extends along the entire length of the leg. This distribution duct 10 possesses a rectangular cross-section and, on the two narrow sides of its jacket, is furnished with steam outlet openings 11, from which the heating steam flows out at right-angles to the length of the serpentine tubes, flows around them and, after appropriate cooling, changes into condensate, which collects in the lower portion of the shell of the preheater, this portion being omitted from the Figure.

Figure 2:
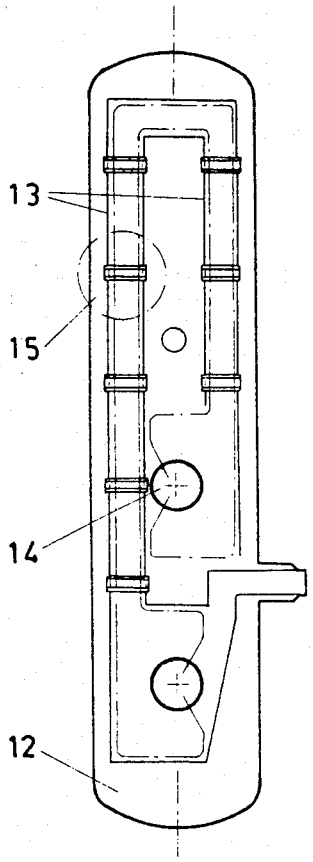

FIG. 2 shows a variant of a vertical high-pressure feed water preheater, of this type, which is represented in its entirety, including the condensate collector 12. Here, in contrast to the design according to FIG. 1, the serpentine tube-bundle is composed of only two legs, and the duct 13 extends over their entire length as far as the feed water inlet header 14.

The two preheaters described above differ from the known preheaters by virtue of the fact that the relative positions of the serpentine tubes, in a direction at right-angles to their longituduainl axes, are fixed within the duct 6 or, as the case may be, 13. Outside the duct 6 or, as the case may be, 13, the tube-bundles are suspended or supported, in the longitudinal direction, in the conventional manner, unimpeded thermal expansion of the tube-bundle being possible in the longitudinal direction.

In FIGS. 1 and 2, the support points, inside the ducts, for mixing the relative positions of the serpentine tubes, at right-angles to their longitudinal direction, are marked 15. A support point of this type is represented, as shown in detail, in FIGS. 3 and 4, FIG. 3 showing a longitudinal section, and FIG. 4 showing a cross-section.

Figure 3:
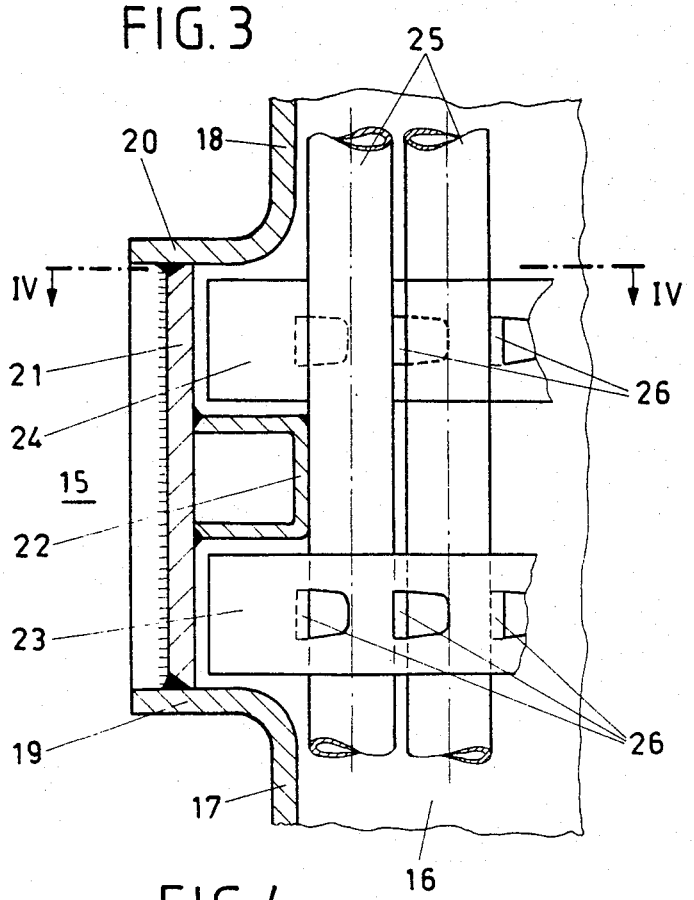
FIG. 3 shows a detail of the invention, in a vertical section.
Figure 4:
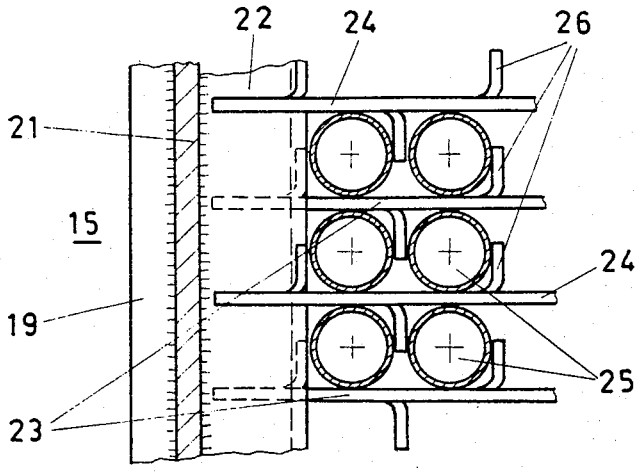
FIG. 4 shows the plan view of the detail of FIG. 3, and FIGS. 5 and 6 respectively show, in elevation and plan view, a support element which forms part of the invention.

FIG. 3 shows a portion of the rear wall 16 of the jacket which forms the duct 6 or 13. The two lateral boundaries of the duct, of which a portion of the left-hand boundary is represented, are assembled from sidewall parts 17 and 18, the ends of which possess outward-pointed, integral sheet-metal flanges 19 and 20, and from web sheets 21 which are welded to the rear wall 16, and to the integral sheet-metal flanges 19 and 20. Supporting crosspieces 22, made of U-profile steel, are welded to the inner surfaces of the web sheets 21, these crosspieces serving as stops for limiting the shifting movements of the upper support strips 24, and of the lower support strips 23, resulting from thermal expansions of the serpentine tubes 25.

In addition, these supporting crosspieces 22 limit the positions of the outermost layers of tubes, and thereby prevent them from chafing againt the sidewalls 17 and 18.

The support strips 23 and 24, of which one is shown in FIGS. 5 and 6, in elevation and in plan view respectively, possess spacer tabs 26, which are produced by stamping the outline of the tab, and by bending it out of the plane of the support strip.

In order that the open flow cross-section for the heating steam be restricted as little as possible, the support strips 23 of the lower plane and the support strips 24 of the upper plane are alternately staggered by one tube-spacing, so that the open flow cross-section is restricted, in each plane, only by half the total cross-section which the support strips 23 and 24 of one support point present, taken together, at right-angles to the flow direction. If, for example, the first support strip 23 of the lower plane of the support point is located between the first and second rows of serpentine tubes, the second lower support strip is then located between the third and fourth rows, and so on, whereas in the upper plane the support strips 24 are arranged between the second and third rows of serpentine tubes, and between the fourth and fifth rows, etc.

Since absolutely no welding operations are required during the assembly of the tube-bundles, the assembly operation is rendered extremely simple. Before the front wall of the desuperheater casing is placed in position, this wall being congruent with the rear wall, a layer of serpentine tubes is inserted into the casing, and a support strip, for example the lower one 23, is fitted. Thereafter, the second layer of serpentine tubes follows, with an upper support strip 24, followed then by the third layer, with a lower cover strip, and so on until the uppermost layer is reached whereupon, although not shown, the front wall is welded, in a leak-tight manner, to the sidewall portions 18 and 19, to the web sheets 21 and, of course, to the lateral bounding walls of the lower, box-shaped portion of the desuperheater casing, which portion encloses the collector 5. Time-consuming fitting and welding operations, as are usual in the case of the known designs of preheater, are completely eliminated in the case of the present design.

This method of holding the tubes at the support points is geometrically positive at right-angles to the axes of the tubes, in all directions, and is therefore proof against vibration, while at the same time permitting free thermal expansion of the tubes, in the longitudinal direction, without any danger of jamming. Due to their ability to shift, the support strips 23 and 24 adjust themselves automatically, during the first start-up, so that the thermal expansion of the tubes does not subsequently cause them constantly to bump about in their mounting and to be pushed backwards and forwards. With their integral sheet-metal flanges 19 and 20 and the supporting crosspieces 22, the support points exert a stiffening action on the duct 6. Instead of two planes of support strips, it is also possible, of course, to provide three planes of strips, or more, if this is necessitated by the weight of the tube-bundle, or by any other circumstances. It is also possible to provide only one layer of support strips, in which case a loss of flow cross-section and hence a higher steam velocity must, of course, be accepted.

I claim:

1. A vertical, collector-type high-pressure feed water preheater, comprising:

a desuperheater casing;

an outlet feed water collector in the form of a duct which is connected with said casing;

a preheater tube-bundle having serpentine tubes wherein at least a portion of said preheater tube-bundle is enclosed in said duct and is contiguous with said outlet feed water collector;

a plurality of support points being present for fixing the position of said preheater tube-bundle at right angles to its length; and a plurality of support strips having spacer tabs wherein said serpentine tubes of said preheater bundle are positively fixed in a region of said support points at right angles to a longitudinal axis thereof;

said duct, on two opposite sidewalls in a region of said support points, further comprising widened portions which, viewed from an interior of said duct, project outward and form support surfaces for said support strips and form stop surfaces for restricting movement thereof in an axial direction of said preheater tube-bundle; and each of said widened portions including pairs of integral sheet metal flanges located on opposite sidewalls of said duct and a web sheet located between each pair of integral sheet metal flanges, wherein a supporting crosspiece is fastened to an inner surface of said web sheet and said support strips are located above and below said supporting crosspiece whereby support strips of a first layer are staggered relative to support strips of a second layer by a single pipe spacing.

* * * * *